United States Patent [19]

Hart

[11] Patent Number: 4,565,435

[45] Date of Patent: Jan. 21, 1986

[54] APPARATUS AND METHOD FOR REMOVING DEVELOPER FROM THE SUMP OF AN ELECTROSTATIC COPYING OR PRINTING MACHINE

[75] Inventor: Lawrence M. Hart, Ontario, N.Y.

[73] Assignee: Xerox Corporation, Stamford, Conn.

[21] Appl. No.: 624,441

[22] Filed: Jun. 25, 1984

[51] Int. Cl.[4] ..... G03G 15/06

[52] U.S. Cl. ..... 355/3 DD; 355/77; 430/122; 118/657

[58] Field of Search ..... 355/3 DD, 3 R, 14 D, 355/77, 4, 15; 118/653, 657, 658; 430/122

[56] References Cited

U.S. PATENT DOCUMENTS

| | | | |
|---|---|---|---|
| 2,975,758 | 3/1961 | Bird, Jr. | 118/637 |
| 3,113,042 | 12/1963 | Hall | 118/637 |
| 3,437,074 | 4/1969 | Hagopian et al. | 118/623 |
| 4,086,006 | 4/1978 | Hauser | 355/4 |
| 4,170,287 | 10/1979 | Edwards et al. | 198/657 |
| 4,235,194 | 11/1980 | Wada et al. | 118/657 |
| 4,330,193 | 5/1982 | Stange | 355/3 DD |
| 4,351,604 | 9/1982 | Karasawa et al. | 355/4 |
| 4,395,114 | 7/1983 | Ura et al. | 355/15 |
| 4,435,073 | 3/1984 | Miller | 355/15 |

*Primary Examiner*—R. L. Moses

*Attorney, Agent, or Firm*—Frederick E. McMullen

[57] ABSTRACT

An electrostatic copying or printing machine having a developing system including a developer housing with a top access opening and a lower sump for storing a quantity of developer, a magnetic brush type developing roll for developing latent electrostatic images on the machine photoconductive member, a paddle wheel having a succession of paddles about the circumference therefor for loading developer from the sump onto the developing roll, and to facilitate clearing developer from the sump preparatory to inserting a fresh developer developer charge, at least one of the paddles being provided with a magnet substantially coextensive therewith for drawing developer from the developer sump to the paddle when the level of developer in the developer sump falls below the path of movement of the paddles, and a removable pick off baffle attachable to the developer housing adjacent the access opening when the sump is to be cleared of developer, the pick off baffle when in place intercepting developer carried by the developing roll and discharging the developer to a point exterior of the developer housing.

6 Claims, 2 Drawing Figures

Figure 1:
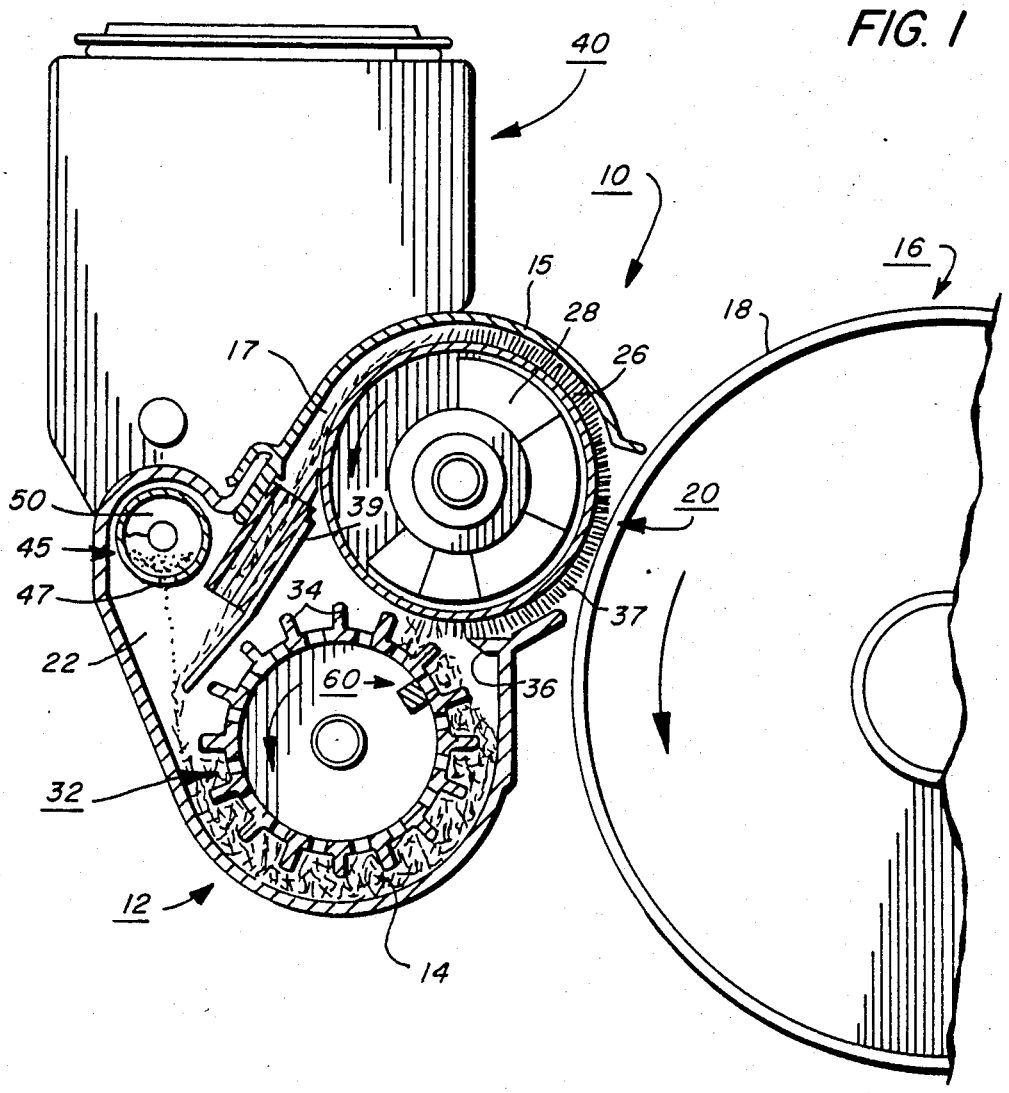

APPARATUS AND METHOD FOR REMOVING DEVELOPER FROM THE SUMP OF AN ELECTROSTATIC COPYING OR PRINTING MACHINE

The invention relates to developing systems for electrostatic copying and printing machines, and more particularly to an improved apparatus and method for removing and cleaning developer from the developer sump.

In electrostatic type copying and printing machines, a latent electrostatic image is created on the photoconductive recording member of the machine. The latent image is thereafter developed by bringing a suitable developer, which may comprise a mixture of carrier and toner particles, into developing relation with the latent image. Following developing, the image is transferred to a copy substrate such as a copy sheet which is then fused to provide a permanent copy.

In machines of this type, it is often desirable to remove or clear the developer from the developer housing sump as for example prior to adding a new developer charge. Obviously, one may provide for this exigency by having an access opening in the bottom of the developer sump with a removable cover. To drain the developer, the cover is removed. However, that arrangement is not usually feasible or practical due to the lack of room below the developer sump that is typical for most machines of this type, since it is here that other xerographic processing components are located. Further, because the space is cramped with other operating components, spillage of developer which often attends attempts to remove the developer cannot be tolerated due to the adverse effect on both machine operation and copy quality.

Another method for purging developer from the developer sump is to remove the entire developer system so that the developer housing can be inverted to permit the developer to drain out. However, this is usually not feasible in the case where the developer housing and components are relatively large and heavy, or where removal thereof entails substantial disassembly of the machine or upsets critical operating tolerances. Additionally, the difficulty in physically handling the developer housing when withdrawing and inverting the housing is often attended by leakage or escape of developer onto adjoining surfaces and parts such as the floor, and on the person handling the developer parts. Further, the design/cost benefits of a non-removable developer housing often far outweigh any perceived advantage in this approach.

While developer housings are typically provided with a removable top cover to permit the housing to be accessed for servicing, removing developer from the developer housing sump by withdrawing the developer through the opening in the top of the housing is not usually practical either. This is chiefly due to the fact that the developer housing is made as small as practical in order to reduce cost, weight, and machine size. This coupled with the presence of many of the developing system operating components within the housing proper, such as the developing roll or rolls, toner transporting augers, mixers, etc. renders access to the bottom of the housing for cleaning purposes extremely difficult if not physically impossible unless some or all of the developing system operating components located in the housing are removed. The latter option is avoided if possible since considerable operator or Tech Rep time may be required to remove the required number of developing system components from the developer housing and then reinstall the parts after the sump has been cleaned out.

The invention provides means to facilitate clearing of residual developer from the sump of the developing system of an electrostatic copying or printing machine wherein the developing system includes a rotatable paddle wheel having a plurality of developer transporting paddles disposed about the circumference thereof adapted on rotation of the paddle wheel to bring measured amounts of developer from the sump to a rotatable magnetic brush developing roll, the developing roll in turn bringing developer supplied by the paddle wheel into developing relation with the machine photoconductive member to develop latent images on the photoconductive member, comprising: a strip like magnet on at least one of the paddles extending substantially the entire length of the paddle, the magnet attracting developer from the sump to the one paddle when the level of developer in the sump falls below the operating level of the paddle wheel whereby to permit the paddle wheel to be used to clear developer from the sump; and pick off baffle means disposable in a developer intercepting position adjacent the developing roll for removing developer supplied to the developer roll by the paddle wheel paddles including the aforesaid one paddle wheel with magnet from the developing roll and conducting the removed developer to a point exterior of the sump.

The invention further provides a method for facilitating cleaning and removing developer from the sump of a developer housing without requiring that the housing be removed or upset or requiring that drain holes be provided or requiring excessive operator time or involvement, comprising the steps of: providing a magnet on at least one of the paddles of the developer paddle wheel; when it is desired to remove the developer from the developer housing sump, installing a pick off baffle in operative scraping relation with the surface of the magnetic developing roll to scrape developer from the surface of the developing roll and direct the removed developer to a point outside the developer housing; rotating the paddle wheel and the magnetic developing roll to cause the paddles to scoop up developer from the sump and transfer the developer to the developing roll for removal by the pick off baffle, and continuing rotation of the paddle wheel and magnetic developing roll after the height of the developer in the sump is below the path of the paddles so that the paddle wheel magnet draws developer from the sump thereto for transfer to the magnetic developing roll and removal from the sump.

IN THE DRAWINGS

Figure 2:
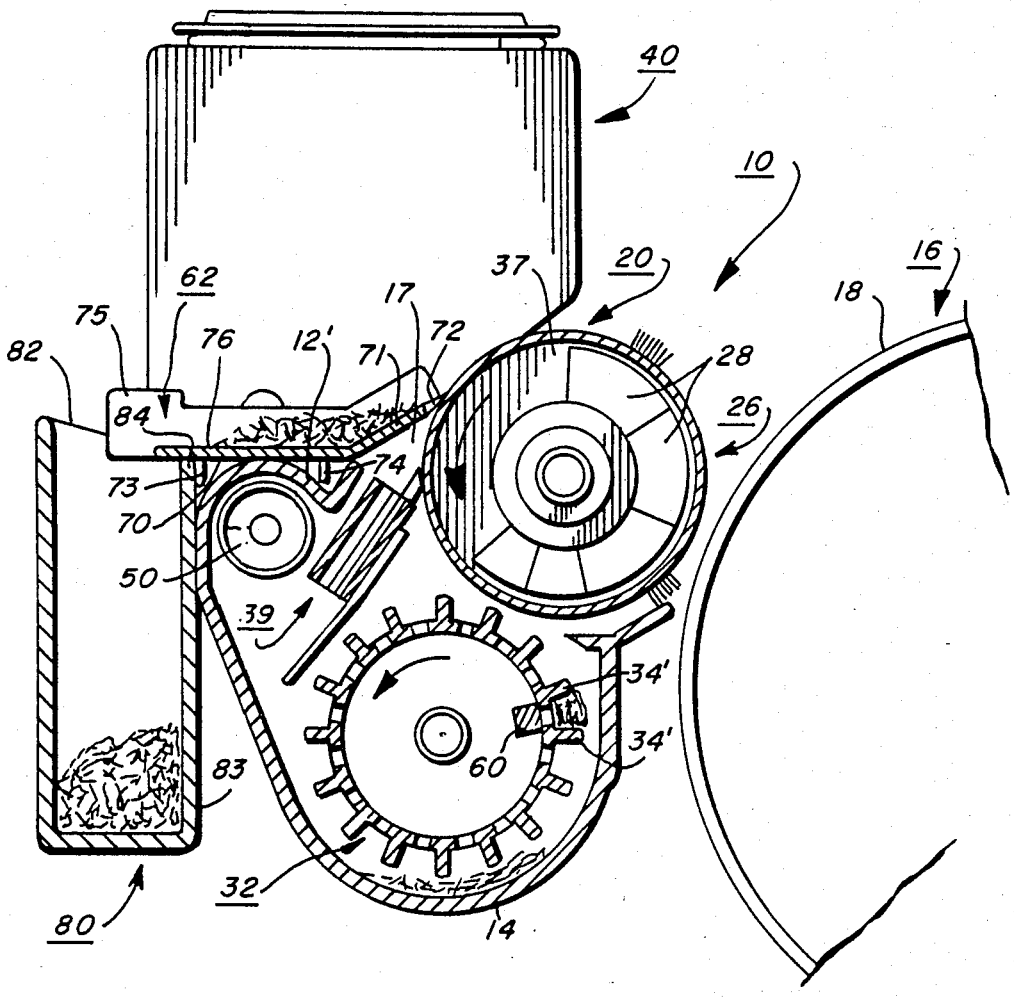

FIG. 1 is a side view partially in section showing details of a developing system incorporating the developer cleaning apparatus and method of the present invention during normal copying operation; and FIG. 2 is a side view partially in section of the developing system in FIG. 1 during removal of developer from the developer sump.

Referring to the drawings, there is shown a developing system, designated generally by the numeral 10, of a xerographic type copying or reproduction machine incorporating the developer dumping apparatus and method of the present invention. Developing system 10 includes a developer housing 12 having a sump 14 within which a developer mixture, typically composed of relatively larger carrier beads and relatively smaller ink particles or toner, resides. The top 15 of housing 12 is removable to uncover an access opening 17 leading to the interior of the developer housing. Access opening 17 is uncovered as for example when servicing or removing the operating components of the developing system housed therewith. Developer housing 12 is suitably supported in predetermined operative relation with the machine photoconductive member, exemplified by a drum 16 having a photoconductive surface 18. Drum 16 is rotated in the direction shown by the solid line arrow in FIG. 1 by suitable drive means (not shown).

As will be understood by those skilled in the xerographic arts, during operation of the copying or reproduction machine, the photoconductive surface 18 of drum 16 is uniformly charged and thereafter exposed to create a latent electrostatic image. The latent electrostatic image is thereafter carried on drum 16 past developing system 10 where the image is developed, with the developed image being thereafter transferred to a copy sheet brought forward from a suitable copy sheet supply in registered relation with the developed image. The unfused image is thereafter fixed or fused to provide a permanent copy. Following transfer, the photoconductive surface 18 of drum 16 is cleaned to remove any leftover developer materials preparatory to charging.

A magnetic brush type developing roll 20 is rotatably journaled in the opposite sides 22 of developer housing 12 in predetermined operative relation with the photoconductive surface 18 of drum 16, the axis of developing roll 20 being parallel to the the axis of rotation of drum 16. Developing roll 20 has an outer rotatable hollow sleeve or cylinder 26 of a suitable non-magnetic material such as aluminum with a stationary array of magnets 28 disposed therewithin, the polarity and angular disposition of magnets 28 being chosen to cause developer to be attracted to the surface of sleeve 26 and carried thereon into developing relation with the photoconductive surface 18 as will appear more fully.

A cylindrical paddle wheel 32 having a plurality of vanes or paddles 34 about the periphery is rotatably journaled in sides 22 of developer housing 12 below developing roll 20, the paths of rotation of sleeve 26 of developing roll 20 and paddle wheel 32 being in closely spaced relation with one another. The axis of paddle wheel 32 is parallel with the axis of drum 16 and developing roll 20. Paddle wheel 32 is located in developer housing 12 such that paddles 34 pass or sweep through sump 14 and the developer mixture therein to carry developer therefrom into proximity with sleeve 26 of developing roll 20, the magnetic force produced by magnets 28 attracting developer carried by paddles 34 to the outer surface of sleeve 26 to load developer onto the developing roll sleeve 26.

A bar-like wiper 36 is formed on developer housing 12 downstream of the point where developer is loaded onto developing roll sleeve 26, the leading edge of wiper 34 being in predetermined spaced relation with the surface of sleeve 26 to remove excess developer and provide a brush-like covering 37 of developer of preset thickness on sleeve 26. Developing roll 20 and paddle wheel 32 are rotated by suitable means (not shown) in the direction shown by the solid line arrows in FIG. 1.

Following movement of the developer brush 37 created on the surface of sleeve 26 of developing roll 20 into operative relation with the photoconductive surface 18 of drum 16, the continued rotation of sleeve 26 carries the developer away from drum 16. As the developer supporting area of sleeve 26 comes opposite the point of no magnetic force, the developer falls by gravity back into sump 14. A suitable cross-mixing baffle 39 extends across the width of developer housing 12 in the path of the returning developer, baffle 39 serving to intermix the carrier and toner particles as they pass back into sump 14 to assure a uniform developer mixture.

Toner is supplied to developer housing 12 from a toner dispensing hopper 40 disposed on one side of developer housing 12. An auger type agitator in the bottom of hopper 40 (not shown) forces toner therein transversely along the hopper to a toner discharge opening in the side of hopper 40 facing developer housing 12 and into a hollow toner dispensing tube 45 which extends transversely across the upper side or top of housing 12. Dispensing tube 45 has a succession of openings or apertures 47 therein connecting tube 45 with the interior of developer housing 12 to allow metered amounts of toner to pass from tube 45 into sump 14. A rotatable toner transporting auger 50 extends through the interior of dispensing tube 45, auger 50 when rotated carrying toner from hopper 40 transversely along the length of toner dispensing tube 45 for discharge into developer housing 12. Auger 50 is rotated by suitable drive means (not shown) periodically on a demand for toner.

In machines of this type, it is often necessary to remove the developer mixture in developer housing 12 as for example when it is desired to add a new developer charge. However, because of a desire to keep the developer housing 12 as small and light as possible in order to keep the overall size and weight of the copying or printing machine with which the developing system 10 is associated as small as possible, and because of the presence of several developing system operating components such as developing roll 20, paddle wheel 32, etc. in the developer housing which tend to block or at least restrict access to sump 14, it is normally very difficult to remove developer by removing the top cover 15 from developer housing 12 and manually accessing the sump 14 through the access opening 17 in the top of the housing. To avoid the need to provide an access opening in the bottom of sump 14 or the need to physically remove the developer housing so that the housing can be inverted to clear the sump of developer, a magnetic strip or bar magnet 60 is attached to paddle wheel 32 between an adjoining pair of paddles 34'. The axial length of magnetic strip 60 is preferably substantially equal to the axial length of the paddles 34'. The magnetic force of strip 60 is less than the magnetic force developed by magnets 28 of developer roll 20 to assure transfer of developer from between paddles 34' to developing roll 20.

Referring particularly to FIG. 2, an elongated generally rectangular blade-like pick off baffle 62, which is removably attachable to the upper surface 12' of housing 12 across access opening 17 following removal of cover 15, is provided to assist in the removal of developer from housing 12. Pick off baffle 62 has a substantially horizontal base section 70 with upwardly rising inlet section 71 which extends toward and into proximity with developer roll 28 on installation of pick off baffle 62 as will appear. The terminal end of inlet section 71 is provided with a flexible lip 72 which extends along the length thereof. A pair of spaced downwardly projecting strengthening ribs 73, 74 extend axially along base section 70 with upstanding side edges 75 provided to prevent escape of developer accumulated on the upper surface 76 of pick off baffle 62.

Pick off baffle 62 is dimensioned such that on mounting of baffle 62 on the top 12' of housing 12 over the access opening 17, the lip 72 of baffle 62 rides against or is in close proximity to the periphery of sleeve 26 of developing roll 20 to remove developer therefrom as sleeve 26 rotates therepast. Developer removed by pick off baffle 62 accumulates on the upper surface 76 prior to dumping thereof into a suitable container 80 as will appear.

Container 80 comprises a generally rectangular box-like receptable, the axial length of which is at least equal to the axial length of baffle 62. Container 80, which has an upper opening 82 for receiving developer, is adapted to be releaseably supported in an upright position on the outside of developer housing 12 by suitable means (not shown). Pick off baffle 62 rests in part on the top edge 84 of the inside wall 83 of container 80 on disposition of baffle 62 in place over access opening 17 of developer housing 12, the outside edge of rib 73 abutting against edge 84 of the container inside wall 83 to locate baffle 62 in place.

To avoid damaging or scoring of the surface of developing roll sleeve 26, lip 72 of pick off baffle 62 is preferably formed from a relatively soft material such as plastic.

When it is desired to clear developer from sump 14 of developer housing 12, cover 15 is removed and container 80 is attached to the outside of developer housing 12 with pick off baffle 62 resting on the upper surface 12' of housing 12 and edge 84 of the inside wall 83 of container 80. Developing roll 20 and paddle wheel 32 are rotated, and where the amount of developer in sump 14 is above the path of movement of paddles 34 therewithin, the developer is picked up by paddles 34 in succession and transferred to sleeve 26 in the manner described previously. Sleeve 26 carries the developer past drum 16 and around to the point where the developer is intercepted by the lip 72 of pick off baffle 62 and guided onto the upper surface 76 of baffle 62 where the developer accumulates. When the upper surface 76 of baffle 62 is substantially covered with developer, baffle 62 may be manually raised in a pivoting motion substantially about the point where rib 73 interengages with edge 83 of the container inside wall 83 to dump the accumulated developer from pick off baffle 62 through opening 82 and into container 80. Presuming that further developer is to be removed, pick off baffle 62 is returned to the developer intercepting position and the process continued. Rotation of developer roll 20 and paddle wheel 32 is preferably stopped while baffle 62 is being cleared of accumulated developer.

As the level of the developer in sump 14 falls below the path of movement of paddles 34, the paddles are no longer able to intercept and raise the developer. However, the magnetic force generated by magnetic strip 60 on paddle wheel 32 draws developer from sump 14 and carries the developer to sleeve 26 of developing roll 20. There, since the mangetic force of magnets 28 is greater than than of magnetic strip 60, the developer carried between paddles 34' is transferred to sleeve 26 and thereafter removed by pick off baffle 62 as described.

The above procedure is continued until sump 14 of developer housing 12 is clear of developer, following which pick off baffle 62 and container 80 are removed leaving the housing 12 ready to receive a fresh charge of developer.

While a single magnetic strip 60 is disclosed, it will be understood that additional strips 60 may be provided between other pairs of paddles 34 of paddle wheel 32. Further, it will be understood that a magnetic type intermediate developer transfer wheel may be provided for conveying developer from paddle wheel 32 to developing roll 20, and in that event, pick off baffle 62 may be arranged to intercept developer carried by such intermediate developer transfer wheel instead of developing roll 20.

While the invention has been described with reference to the structure disclosed, it is not confined to the details set forth, but is intended to cover such modifications or changes as may come within the scope of the following claims.

I claim:

1. In an electrostatic type reproduction or printing apparatus having a photoconductive member on which latent electrostatic images are produced, and developing means for developing said images, said developing means including a developer housing having a lower sump for holding developer for developing said images, at least one magnetic brush developing roll for bringing developer into developing relation with said photoconductive member to develop said images, and a developer transfer wheel having a succession of paddles around the circumference thereof for carrying developer from said sump to said developing roll, the improvement comprising:

(a) magnet means on at least one of said paddles for attracting developer from said sump to said one paddle when the level of developer in said sump falls below the operating level of said paddles whereby to enable said developer transfer wheel to be used in clearing said sump of developer; and (b) developer pick off means disposable adjacent said developing roll to intercept and remove developer on said developing roll, said developer pick off means forming a path for conducting developer removed from said developing roll to a point external of said developer housing.

2. The apparatus according to claim 1 in which said developer housing has an access opening adjacent the top thereof to permit servicing of said developing means and loading of a fresh developer charge into said sump, said developer pick off means comprising a blade-like element attachable to said developer housing over said access opening whereby developer removed from said developing roll is conducted by said pick off means element across said access opening to a point external of said developer housing.

3. The apparatus according to claim 2 in which said developing means includes a removable cover for closing said developer housing access opening when processing copies.

4. Means to facilitate clearing of residual developer from the sump of the developing system of an electrostatic copying or printing machine, said developing system including a rotatable paddle wheel having a plurality of developer transporting paddles disposed about the circumference thereof, said paddles on rotation of said paddle wheel moving through said sump to bring measured amounts of developer from said sump to a rotatable magnetic brush developing roll, said developing roll bringing developer supplied by said paddle wheel into developing relation with the machine photoconductive member to develop latent images on said photoconductive member, comprising:

(a) a strip like magnet on at least one of said paddles, said magnet extending substantially the entire length of said paddle, said magnet attracting developer from said sump to said paddle when the level of developer in said sump falls below the operating level of said paddles whereby to bring residual developer from said sump to said developing roll, and (b) pick off baffle means having a developer intercepting surface in the path of developer on said developing roll for removing developer from said developing roll and conducting removed developer to a point exterior of said sump.

5. The means according to claim 4 in which said pick off baffle means is removable following clearing of developer from said sump.

6. A method of clearing developer from the sump of the developer housing of an electrostatic printing or copying machine without requiring that the housing be removed, said machine having a photoreceptor on which latent electrostatic images are formed, at least one rotatable magnetic type developing roll in said housing for bringing developer into developing relation with said photoreceptor to develop said images, and a rotatable paddle wheel having discrete developer transporting paddles about the periphery thereof in said housing for supplying measured amounts of developer from said sump to said developing roll, comprising the steps of:

(a) magnetizing at least one of said paddle wheel paddles;

(b) rotating said paddle wheel and said developing roll so that said paddles carry developer from said sump to said developing roll;

(c) removing the developer from said developing roll;

(d) guiding the removed developer to a point exterior of said housing;

(e) continuing rotation of said paddle wheel and said developing roll after the level of developer remaining in said sump falls below the operating level of said paddles using said magnetized paddle to draw developer remaining in said sump to said magnetized paddle so that any remaining developer in said sump is carried by said magnetized paddle to said developing roll;

(f) continuing steps c and d to clear developer from said developing roll and guide the removed developer to a point exterior of said housing; and (g) continuing step f until substantially all of the developer is removed from said sump.

* * * * *